US007579300B2

(12) United States Patent
Mori

(10) Patent No.: US 7,579,300 B2
(45) **Date of Patent: *Aug. 25, 2009**

(54) IMAGE RECORDING MATERIAL AND IMAGE FORMATION PROCESS THEREOF

(75) Inventor: Takahiro Mori, Hachioji (JP)

(73) Assignee: Konica Minolta Medical & Graphic, Inc., Tokyo (JP)

( * ) Notice: Subject to any disclaimer, the term of this patent is extended or adjusted under 35 U.S.C. 154(b) by 484 days.

This patent is subject to a terminal disclaimer.

(21) Appl. No.: 11/438,513

(22) Filed: May 22, 2006

(65) Prior Publication Data

US 2006/0270553 A1 Nov. 30, 2006

(30) Foreign Application Priority Data

May 30, 2005 (JP) ..... 2005-157001

(51) Int. Cl.
*B41M 5/26* (2006.01)

(52) U.S. Cl. ..... 503/201; 430/945; 503/207

(58) Field of Classification Search ..... None
See application file for complete search history.

(56) References Cited

U.S. PATENT DOCUMENTS 7,107,905 B2 * 9/2006 Mori ..... 101/453

FOREIGN PATENT DOCUMENTS

| | | | |
|---|---|---|---|
| JP | 11-140270 | A | 5/1999 |
| JP | 2000-225780 | A | 8/2000 |
| JP | 2002-205466 | A | 7/2002 |
| JP | 2003-231374 | A | 8/2003 |

* cited by examiner

*Primary Examiner*—Bruce H Hess
(74) *Attorney, Agent, or Firm*—Frishauf, Holtz, Goodman & Chick, P.C.

(57) ABSTRACT

An object of the present invention is to provide an image recording material exhibiting an excellent exposure visualization property as well as an image formation process employing the image recording material, and further to provide not only a printing plate material exhibiting excellent on-press developability and printing durability, but also an image formation process employing the printing plate material, accompanied with an excellent exposure visualization property. Also disclosed is an image recording material possessing a support and provided thereon, a thermosensitive image formation layer, wherein the thermosensitive image formation layer contains thermoplastic spherical particles having an average particle diameter of 100-500 nm, and exhibits a structural color originated with the thermoplastic spherical particles.

7 Claims, No Drawings

IMAGE RECORDING MATERIAL AND IMAGE FORMATION PROCESS THEREOF

This application claims priority from Japanese Patent application No. 2005-157001 filed on May 30, 2005, which is incorporated hereinto by reference.

TECHNICAL FIELD

The present invention relates to an image recording material and an image formation process employing the image recording material, and particularly to a thermosensitive printing plate material and an image formation process employing the thermosensitive printing plate material utilized in a computer to plate (CTP) system.

BACKGROUND

Presently, printing employing a CTP system has been conducted in printing industries, accompanied with the digitization of printing data. A printing plate material for CTP, which is inexpensive, can be easily handled, and has printability comparable with that of a PS plate, is required.

Particularly in recent years, a printing plate material has been sought which does not require any development employing a developer containing specific chemicals (such as alkalis, acids, and solvents), and can be applied to a conventional printing press. Known are a chemical-free type printing plate material such as a phase change type printing plate material requiring no development process, a printing plate material which can be processed with water or a neutral processing liquid comprised mainly of water, or a printing plate material capable of being developed on a printing press at initial printing stage and requiring no development process; and a printing plate material called a processless printing plate material.

In the CTP system, a process so-called "plate inspection" is required in present work flow as in a conventional PS plate. In the case where a printing plate material is developed and punched to form holes for mounting on a plate cylinder of a printing press, register marks are read through employing a dedicated device and their correct positions are determined. Therefore, it is necessary to have a reflection density difference between image portions and non-image portions of the developed printing plate material whereby the register marks can be read, and a printing plate material is required to provide a so-called development visualization property.

A printing plate material requiring no development process or a processless printing plate material to be developed on a plate cylinder of a printing press is required to provide an exposure visualization property, since it is punched after imagewise exposure to form holes for mounting on the plate cylinder.

In order to add this visualization property, there has been proposed a printing plate material possessing a hydrophilic overcoat layer, which is capable of being removed on a printing press, containing at least 20% by weight of a cyanine infrared absorbing dye whose optical density varies due to exposure (refer to Patent Document 1).

This printing plate material gives good exposure image visualization, but it is difficult to avoid color contamination caused due to development-on-press, since the high dye content of the overcoat layer to be removed on a printing press exhibits a high color density in either exposed potions or unexposed portions, whether a color density of the layer increases or decreases due to exposure.

An infrared absorbing dye contained in an image formation layer, which discolors on exposure, is commonly known, but in the printing plate material possessing an image formation layer containing such an infrared absorbing dye, increase of the difference in color density between exposed portions and unexposed portions is to increase a color density of the image formation layer at unexposed portions, resulting in color contamination due to the image formation layer at the unexposed portions during developing on a printing press (refer to Patent Document 2).

As a printing plate material developable on a printing press, there is known a printing plate material possessing an image formation layer containing materials colored via heating such as a leuco dye and a color developing agent, wherein only exposed portions or hydrophobic image portions color (refer to Patent Document 3).

This printing plate material, in which the image formation layer at non-image portions to be removed during printing, has a relatively low color density, and reduces degree of color contamination, compared with one employing a dye which discolors on exposure. However, there is problem in that image portions to have been colored partially have regions with a low water resistance, resulting in color contamination due to colored image portions.

On the other hand, a processless printing plate material is imagewise exposed employing an infrared laser with an emission wavelength of from near-infrared to infrared regions to form an image. The thermal processless printing plate material employing this method may be divided into two types; an ablation type printing plate material and a development-on-press type printing plate material with a heat melting image formation layer.

Examples of the ablation type printing plate material include those disclosed in Published Japanese Translation of PCT International Publication No. 8-507727, and Japanese Patent O.P.I. Publication Nos. 6-186750, 6-199064, 7-314934, 10-58636 and 10-244773.

These references disclose a printing plate material possessing a support, and provided thereon, a hydrophilic layer and a lipophilic layer, either of which is an outer layer. When a printing plate material is imagewise exposed in which the hydrophilic layer is an outer layer, the hydrophilic layer is removed by ablation to reveal the lipophilic layer, whereby an image is formed.

However, this printing plate material produces a problem such that the exposure device is contaminated by the ablated material, resulting in low versatility to an exposure device, and specifically, the exposure device is required to be equipped with an additional suction device.

A printing plate material has been developed which is capable of forming an image without ablation, and does not require development treatment employing a special developer or wiping-off treatment. Known are, for example, a printing plate material disclosed in Japanese Patent Nos. 2938397 and 2938398 which comprises a hydrophilic layer or a grained aluminum plate and provided thereon, a photosensitive image formation layer containing thermoplastic particles, a water soluble binder and a light-heat conversion material, as the development-on-press type printing plate material; and a printing plate material which forms an image via heat generation of a light-heat conversion material by containing the light-heat conversion material in a hydrophilic layer (refer to Patent document 4).

Though such a printing plate material is capable of reproducing a comparatively high-resolution image, and is usable as a processless printing plate material, an insufficient exposure visualization property results. Even though a process of adding the above visualization property is also utilized, the visualization property is still insufficient, and as a result, it was difficult to improve a visualization property in the state of maintaining printing durability and on-press developability (particularly initial printability).

(Patent Document 1) Japanese Patent O.P.I. Publication No. 2002-205466

(Patent Document 2) Japanese Patent O.P.I. Publication No. 2000-225780

(Patent Document 3) Japanese Patent O.P.I. Publication No. 11-140270

(Patent Document 4) Japanese Patent O.P.I. Publication No. 2003-231374

SUMMARY

It is an object of the present invention to provide an image recording material exhibiting an excellent exposure visualization property as well as an image formation process employing the image recording material, and further to provide not only a printing plate material exhibiting excellent on-press developability and printing durability, but also an image formation process employing the printing plate material, accompanied with an excellent exposure visualization property.

DESCRIPTION OF THE PREFERRED EMBODIMENTS

The above object of the present invention is accomplished by the following structures.

(Structure 1) An image recording material possessing a support and provided thereon, a thermosensitive image formation layer, wherein the thermosensitive image formation layer contains thermoplastic spherical particles having an average particle diameter of 100-500 nm, and exhibits a structural color originated with the thermoplastic spherical particles.

(Structure 2) The image recording material of Structure 1, wherein the thermoplastic spherical particles exhibit an achromatic color.

(Structure 3) The image recording material of Structure 1 or 2, wherein a layer containing a light-heat conversion material is provided on the thermosensitive image formation layer side of the support.

(Structure 4) The image recording material of any one of Structures 1-3, wherein the support has a hydrophilic layer, and the image recording material is a printing plate material.

(Structure 5) The image recording material of Structure 4, wherein the thermosensitive image formation layer is a layer that is developable on a printing press.

(Structure 6) A process of forming an image on the image recording material of any one of Structures 1-5, wherein the image recording material is imagewise heated to change the structural color.

(Structure 7) The process of forming an image on the image recording material of Structure 6, wherein imagewise heating is conducted via infrared laser exposure.

While the preferred embodiments of the present invention have been described using specific terms, such description is for illustrative purposes only, and it is to be understood that changes and variations may be made without departing from the spirit or scope of the appended claims.

DETAILED DESCRIPTION OF THE INVENTION

Next, the present invention will be described in detail.

It is a feature of the present invention to provide an image recording material possessing a support and provided thereon, a thermosensitive image formation layer, wherein the thermosensitive image formation layer contains thermoplastic spherical particles having an average particle diameter of 100-500 nm, and exhibits a structural color originated with the thermoplastic spherical particles.

An image recording material possessing a thermosensitive image formation layer containing thermoplastic spherical particles having an average particle diameter of 100-500 nm, and exhibiting a structural color originated with these thermoplastic spherical particles, is imagewise heated to change this structural color, whereby an image formation process exhibiting an excellent exposure visualization property can be provided.

(Thermosensitive Image Formation Layer)

The thermosensitive image formation layer of the present invention is a layer capable of forming an image via imagewise heating, contains thermoplastic spherical particles having an average particle diameter of 100-500 nm, and exhibits a structural color originated with these thermoplastic spherical particles. "Structural color" of the present invention means that refraction, diffraction, scattering and interference of light occur when particles exhibiting substantially achromatic color are orderly arrayed, whereby vertically reflected light visualized under visible wavelength light exposure exhibits chromatic color.

The average particle diameter of the present invention is a mean value calculated by measuring the diameter of regularly dispersed particles contained in a thermosensitive image formation layer. The long and short axis diameters of a particle are determined from electron micrograph images, and the particle diameter is a mean value of these long and short axis diameters. Diameters of particles contained in any area of 1 $m^2$ of a thermosensitive image formation layer are obtained, and the average particle diameter is a number average value of these particle diameters.

The average particle diameter of the present invention is required to be 100-500 nm in order to obtain a structural color, and preferably 150-300 nm in view of coloring of a structural color.

It is preferable that particles of the present invention are substantially particles exhibiting an achromatic color, and any of inorganic and organic particles can be usable.

"Substantially achromatic color" means a color with no intensity of white, gray and black.

Further, the particles of the present invention are preferably organic particles in view of coloring as well as on-press developability in the case of employing for a printing plate material, and more preferably organic polymer particles.

Among the organic polymer particles, thermoplastic organic polymer particles are preferably usable.

As a particle shape, spherical shape is preferable in view of structural coloring, on-press developability in the case of employing for a printing plate material, and so forth. The spherical particles described here mean particles having a needle-like shape ratio of 1-1.5.The needle-like shape ratio means a ratio of a long axis to a short axis diameter (long axis diameter/short axis diameter) measured from electron micrographic images.

Particles of the present invention are preferably thermoplastic spherical particles exhibiting an achromatic color substantially, and more preferably spherical thermoplastic organic polymer particles exhibiting an achromatic color.

Examples of the organic polymer as organic polymer particles include polymers such as (meth)acrylic polymer, (meth)acrylic-styrene based organic polymer, styrene based organic polymer, and styrene-butadiene based organic polymer.

Particles of the present invention are also arranged so as to be orderly arrayed. "Ordered array" means the array with an array structure having a given periodicity.

There is a process such that particles are dispersed in an image formation layer coating solution as primary particles as an ordered array process to form a thermosensitive image formation layer, whereby an ordered array of particles is formed via coating on a support and then drying.

The ordered array is adjustable by appropriately adjusting a coating solution viscosity, a solid content ratio, and drying condition.

By coating a water-soluble coating solution in which particles are dispersed, on a support having a highly hydrophilic and evenly fine roughened surface, the coating solution can also be evenly coated onto the support, and be evenly dried, whereby a well-ordered array of particles can be obtained.

When the content ratio of particles having a particle diameter of 100-500 nm in the solid content of a thermonsensitive image formation layer coating solution is increased (preferably at least 70% by weight, based on the total solid content, and more preferably at least 80% by weight), the particles result substantially in a close-packed and ordered array of particles.

It is preferable that particles of the present invention have not only an ordered array, but also a uniform particle diameter. Specifically, the variation coefficient of a particle diameter distribution in the foregoing particle diameter measurements; CV value (%)={(standard deviation of particle diameter/average particle diameter)×100} is preferably at most 10%, and more preferably at most 7%.

Glass transition temperature (Tg) of the above thermoplastic spherical particles is preferably 50-200° C. in view of storage stability, thermosensitive recording, and sensitivity, and more preferably 60-150° C.

The thermoplastic spherical particles may be composed of a core/shell structure, and may also contain various functional groups capable of reacting to other substances.

Though the thermoplastic spherical particles can be colored to an achromatic color of gray to black employing a commonly known method described in Japanese Patent O.P.I. Publication Nos. 2004-269922 and 2004-276492, coloring free is preferable in view of printing press contamination during developing on a printing press.

Coloring of a structural color can be enhanced by using a chromatic color colorant in combination, though an image recording material of the present invention exhibits coloring of the chromatic color as a structural color without containing the chromatic color colorant (pigment, dye and the like).

Specifically, reflected light of a structural color is further enhanced by using in combination a colorant absorbing the wavelength deflected from the peak wavelength with respect to a peak wavelength in a reflected spectrum of the structural color, whereby a clear chromatic color is exhibited.

The above effects can also be obtained by coloring the support surface, though the colorant is contained in the thermosensitive image formation layer. Excellent coloring of the structural color can be obtained by employing a black matte surface (roughened surface substantially with no reflected light) for the surface of a support.

In the image formation method of the present invention, an image recording material possessing a thermosensitive image formation layer exhibiting a structural color is imagewise heated, and this structural color is changed to conduct the image recording.

The imagewise heating can be carried out via heating with a thermal head, heating with laser exposure, or such.

An array of particles in a thermosensitive image formation layer of the present invention is changed by heating, and a structural color is changed at heated portions, whereby a fadeless image is recordable.

It is provided as changes in an array of the above particles, for example, that thermoplastic spherical particles are melted to fuse particle-to-particle, and to annihilate the array structure of particles entirely.

In this case, when thermoplastic spherical particles are fused at image recording portions (heated portions) to annihilate the array structure of particles, a clear contrast is distinguishably acquired in comparison to non-recording portions exhibiting a structural color to recognize visual images clearly, since the recording portions do not exhibit a structural color.

Since image recording can be easily conducted via infrared laser exposure by adding a light-to-heat conversion function to an image recording material (providing a layer containing a light-to-heat conversion agent), it is possible in this case to form fadeless and high-resolution visual images.

A commonly known pigment or dye as described later can be employed as a light-to-heat conversion agent. The light-to-heat conversion agent may be contained in a thermosensitive image formation layer, and be contained in a structural layer other than the thermosensitive image formation layer. The light-to-heat conversion agent may also be contained in plural structural layers.

The embodiment in which an intermediate layer containing a black color light-to-heat conversion agent between a thermosensitive image formation layer and a support is provided is one of the preferable embodiments, since not only the intermediate layer is capable of adding light-to-heat conversion ability, but also structural color enhancement effects are possible to be added.

It is preferable in the present invention that the support has a hydrophilic layer, and the image recording material is a printing plate material possessing a thermosensitive image formation layer provided on this hydrophilic layer.

It is preferable to provide a printing plate material possessing a support and provided thereon, a thermosensitive image formation layer, wherein the thermosensitive image formation layer contains particles having an average particle diameter of 100-500 nm, and exhibits a structural color originated with these particles.

Regarding the above printing plate material, excellent visual images are formed, since a non-recorded thermosensitive image formation layer exhibits a structural color as described above, and the structural color at the portions recorded via heating is changed or annihilated.

It is preferable that the thermosensitive image formation layer is developable on a printing press.

In the case of using as a printing plate material, provided is one of the preferable embodiments in which particles of the present invention are preferably thermoplastic spherical particles, and these thermoplastic spherical particles are fused at recording portions (heated portions), resulting in ink receptive image portions.

Also provided is one of the preferable embodiments in which thermoplastic spherical particles are incorporated with each other via a crosslinking agent or binder, resulting in the ink receptive image portions, even though these particles are not fused.

In this case, thermoplastic spherical particles are desired to be thermally deformed from spherical to irregular form. The thermal deformation degree is the level at which changes in structural color are preferably distinguishable, and the structural color is more preferably annihilated sufficiently.

The thermosensitive image formation layer containing the above particles of the present invention can be formed by coating a coating solution containing binder and the particles. In the case of using as a printing plate material, the thermosensitive image formation layer may contain water-soluble binder, a crosslinking agent, a light-to-heat conversion agent, a pH adjusting agent, a surfactant, an organic filler, or an inorganic filler, if desired.

(Light-Heat Conversion Material)

Infrared absorbing dyes or pigments may be employed as the above light-heat conversion material.

(Infrared Absorbing Dye)

Examples of the light-heat conversion material include a cyanine dye, a chloconium dye, a polymethine dye, an azulenium dye, a squalenium dye, a thiopyrylium dye, a naphthoquinone dye or an anthraquinone dye, and an organometallic complex such as a phthalocyanine compound, a naphthalocyanine compound, an azo compound, a thioamide compound, a dithiol compound and an indoaniline compound. Exemplarily, the light-heat conversion materials include compounds disclosed in Japanese Patent O.P.I. Publication Nos. 63-139191, 64-33547, 1-160683, 1-280750, 1-293342, 2-2074, 3-26593, 3-30991, 3-34891, 3-36093, 3-36094, 3-36095, 3-42281, 3-97589, 3-103476, 7-43851, 7-102179 and 2001-117201. These compounds may be used singly or in combination.

Examples of pigments include carbon, graphite, a metal and a metal oxide.

Furnace black or acetylene black is preferably used as the carbon. The graininess ($d_{50}$) thereof is preferably not more than 100 nm, and more preferably not more than 50 nm.

The graphite is one having a particle size of preferably not more than 0.5 μm, more preferably not more than 100 nm, and most preferably not more than 50 nm.

As the metal, any metal can be used as long as the metal is in a form of fine particles having preferably a particle size of not more than 0.5 μm, more preferably not more than 100 nm, and most preferably not more than 50 nm. The metal may have any shape such as spherical, flaky and needle-like. Colloidal metal particles such as those of silver or gold are particularly preferred.

As the metal oxide, materials having black color in the visible regions, or electro-conductive materials or semi-conductive materials can be used. Examples of the materials having black color in the visible regions include black iron oxide ($Fe_3O_4$), and black complex metal oxides containing at least two metals. Black complex metal oxides comprised of at least two metals are preferred. Typically, the black complex metal oxides include complex metal oxides comprising at least two selected from Al, Ti, Cr, Mn, Fe, Co, Ni, Cu, Zn, Sb, and Ba. These can be prepared according to the methods disclosed in Japanese Patent O.P.I. Publication Nos. 9-27393, 9-25126, 9-237570, 9-241529 and 10-231441.The complex metal oxide used in the invention is preferably a complex Cu-Cr-Mn type metal oxide or a Cu-Fe-Mn type metal oxide. The Cu-Cr-Mn type metal oxides are preferably subjected to the treatment disclosed in Japanese Patent O.P.I. Publication Nos. 8-27393 in order to reduce isolation of a 6-valent chromium ion. These complex metal oxides have a high color density and a high light-heat conversion efficiency as compared with another metal oxide. The primary average particle size of these complex metal oxides is preferably from 0.001 to 1.0 μm, and more preferably from 0.01 to 0.5 μm. The primary average particle size of from 0.001 to 1.0 μm improves a light-heat conversion efficiency relative to the addition amount of the particles, and the primary average particle size of from 0.05 to 0.5 μm further improves a light-heat conversion efficiency relative to the addition amount of the particles. The light-heat conversion efficiency relative to the addition amount of the particles depends on a dispersity of the particles, and the well-dispersed particles have a high light-heat conversion efficiency. Accordingly, these complex metal oxide particles are preferably dispersed according to a known dispersing method, separately to a dispersion liquid (paste), before being added to a coating liquid for the particle containing layer. The metal oxides having a primary average particle size of less than 0.001 are not preferred since they are difficult to disperse. A dispersant is optionally used for dispersion. The addition amount of the dispersant is preferably from 0.01 to 5% by weight, and more preferably from 0.1 to 2% by weight, based on the weight of the complex metal oxide particles. Kinds of the dispersant are not specifically limited, but the dispersant is preferably a silicon-containing surfactant.

Examples of the electro-conductive materials or semi-conductive materials include Sb-doped $SnO_2$ (ATO), Sn-added $In_2O_3$ (ITO), $TiO_2$, TiO prepared by reducing $TiO_2$ (titanium oxide nitride, generally titanium black). Particles prepared by covering a core material such as $BaSO_4$, $TiO_2$, $9Al_2O_3 \cdot 2B_2O$ and $K_2O \cdot nTiO_2$ with these metal oxides is usable. The particle size of these particles is preferably not more than 0.5 μm, more preferably not more than 100 nm, and most preferably not more than 50 nm.

The addition amount of the light-heat conversion materials is preferably 0.1 to 50% by weight, more preferably 1 to 30% by weight, and most preferably 3 to 25% by weight based on the weight of the layer to which the material are added.

(Thermosensitive Image Formation Layer of Printing Plate Material)

When an image recording material is a printing plate material, a thermosensitive image formation layer contains a hydrophobic precursor. It is preferred in the present invention that particles of the present invention having an average particle diameter of 100-500 nm serve for the hydrophobic precursor. Hydrophobic precursors other than the foregoing particles may be contained as the hydrophobic precursor. In this case, it is preferable that the content of the other hydrophobic precursor is 0-10% by weight, based on the weight of the foregoing particles.

A thermoplastic-hydrophobic particle such as a heat melting particle or a heat fusible particle, a microcapsule encapsulating a hydrophobic material, a blocked isocyanate compound, or such can be employed as the other hydrophobic precursor.

Heat melting particles are particularly particles having a low melt viscosity among thermoplastic materials, which are particles formed from materials generally classified into wax. The materials preferably have a softening point of 40-120° C. and a melting point of 60-150° C., and more preferably a softening point of 40-100° C. and a melting point of 60-120° C. A melting point less than 60° C. provides poor storage stability, while a melting point exceeding 150° C. provides poor ink receptivity.

Materials usable include paraffin, polyolefin, polyethylene wax, microcrystalline wax, and fatty acid wax. The molecular weight thereof is approximately from 800 to 10,000.A polar group such as a hydroxyl group, an ester group, a carboxyl group, an aldehyde group and a peroxide group may be introduced into the wax by oxidation to increase the emulsification ability. Moreover, stearoamide, linolenamide, laurylamide, myristylamide, hardened cattle fatty acid amide, parmitylamide, oleylamide, rice bran oil fatty acid amide, palm oil fatty acid amide, a methylol compound of the above-mentioned amide compounds, methylenebissteastearoamide and ethylenebissteastearoamide may be added to the wax to lower the softening point or to raise the working efficiency. A cumarone-indene resin, a rosin-modified phenol resin, a terpene-modified phenol resin, a xylene resin, a ketone resin, an acryl resin, an ionomer and copolymers of these resins may also be usable.

Among them, polyethylene, microcrystalline, fatty acid ester, or fatty acid is preferably contained. A high sensitive image formation can be performed since these materials each have a relative low melting point and a low melt viscosity.

The heat melting particles are preferably dispersible in water. The average particle size thereof is preferably 0.01-10 μm, and more preferably 0.1-3 μm.

The composition of the heat melting particles may be continuously varied from the interior to the surface of the particles. The particles may be covered with a different material.

Known microcapsule production method or sol-gel method can be applied for covering the particles.

The heat melting particle content of the image formation layer is preferably 1-90% by weight, and more preferably 5-80% by weight.

The heat fusible particles include thermoplastic hydrophobic polymer particles. Although there is no specific limitation to the upper limit of the softening point of the thermoplastic hydrophobic polymer, the softening point is preferably lower than the decomposition temperature of the polymer. The weight average molecular weight (Mw) of the thermoplastic hydrophobic polymer is preferably within the range of from 10,000 to 1,000,000.

Examples of the polymer constituting the polymer particles include a diene (co)polymer such as polypropylene, polybutadiene, polyisoprene or an ethylene-butadiene copolymer; a synthetic rubber such as a styrene-butadiene copolymer, a methyl methacrylate-butadiene copolymer or an acrylonitrile-butadiene copolymer; a (meth)acrylate (co)polymer or a (meth)acrylic acid (co)polymer such as polymethyl methacrylate, a methyl methacrylate-(2-ethylhexyl) acrylate copolymer, a methyl methacrylate-methacrylic acid copolymer, or a methyl acrylate-(N-methylolacrylamide); polyacrylonitrile; a vinyl acetate (co)polymer such as a polyvinyl acetate, a vinyl acetate-vinyl propionate copolymer, a vinyl acetate-2-hexylethyl acrylate copolymer or a vinyl acetate-ethylene copolymer; vinyl chloride (co)polymer; vinylidene chloride (co)polymer; and styrene (co)polymer. Among them, the (meth)acrylate polymer, the (meth)acrylic acid (co)polymer, the vinyl ester (co)polymer, the polystyrene and the synthetic rubbers are preferably used.

The heat fusible particles are preferably dispersible in water. The average particle size of the heat fusible particles is preferably 0.01-10 μm in view of on-press developability and sensitivity, and more preferably 0.1-3 μm.

Further, the composition of the heat fusible particles may be continuously varied from the interior to the surface of the particles. The particles may be covered with a different material.

As a covering method, known methods such as a microcapsule method and a sol-gel method are usable.

The thermoplastic particle content of the image formation layer is preferably 1-90% by weight, and more preferably 5-80% by weight.

Usable microcapsules include those encapsulating hydrophobic materials disclosed in Japanese Patent O.P.I. Publication Nos. 2002-2135 and 2002-19317. The average microcapsule diameter of the microcapsules is preferably 0.1-10 μm, more preferably 0.3-5 μm, and still more preferably 0.5-3 μm.

[Blocked Isocyanate Compound]

A blocked isocyanate compound is a compound in which a blocking material is added into an isocyanate compound via reaction.

A blocked isocyanate compound usable for an image formation layer is preferably a water-dispersible compound.

[Isocyanate Compound]

Examples of the isocyanate compound include an aromatic polyisocyanate such as diphenylmethane diisocyanate (MDI), tolylene diisocyanate (TDI), polyphenylpolymethylene polyisocyanate (crude MDI), or naphthalene diisocyanate (NDI); an aliphatic polyisocyanate such as 1,6-hexamethylene diisocyanate (HDI), or lysine diisocyanate (LDI); an alicyclic polyisocyanate such as isophorone diisocyanate (IPDI), dicyclohexylmethane diisocyanate (hydrogenation MDI), or cyclohexylene diisocyanate; an aromatic aliphatic Polyisocyanate such as xylylene diisocyanate (XDI), or tetramethylxylene diisocyanate (TMXDI); and their modified compounds such as those having a burette group, an isocyanurate group, a carbodiimide group, or an oxazolidine group); and a urethane polymer having an isocyanate group in the molecular end, which is comprised of an active hydrogen-containing compound with a molecular weight of 50-5,000 and the polyisocyanate described above.

The polyisocyanates described in Japanese Patent O.P.I. Publication No. 10-72520 are preferably used.

Among those polyisocyanates, tolylene diisocyanate is especially preferred in view of high reactivity.

[Blocking Material]

Examples of the blocking material include an alcohol type blocking material such as methanol, or ethanol; a phenol type blocking material such as phenol or cresol; an oxime type blocking material such as formaldoxime, acetaldoxime, methyl ethyl ketoxime, methyl isobutyl ketoxime, cyclohexanone oxime, acetoxime, diacetyl monoxime, or benzophenone oxime; an acid amide type blocking material such as acetanilide, ε-caprolactam, or γ-butyrolactam; an active methylene containing blocking material such as dimethyl malonate or methyl acetoacetate; a mercaptan type blocking material such as butyl mercaptan; an imide type blocking material such as succinic imide or maleic imide; an imidazole type blocking material such as imidazole or 2-methylimidazole; a urea type blocking material such as urea or thiourea; an amine type blocking material such as diphenylamine or aniline; and an imine type blocking material such as ethylene imine or polyethylene imine. Among these, the oxime type blocking material is preferred.

It is preferred that the content of the blocking material is such an amount that the amount of the active hydrogen of the blocking material is 1.0-1.1 equivalent of the isocyanate group of the isocyanate compound. It is preferred that when an active hydrogen-containing additive such as a polyol described later is used in combination, the content of the blocking material is such an amount that the total amount of the active hydrogen of the blocking material and the additive is 1.0-1.1 equivalent of the isocyanate group of the isocyanate compound. The amount less than 1.0 equivalent of the active hydrogen produces an unreacted isocyanate group, while the amount exceeding 1.1 equivalent of the active hydrogen results in excess of blocking material, which is undesirable.

The releasing temperature of blocking material from the blocked isocyanate compound is preferably 80-200° C., more preferably 80-160 C., and still more preferably 80-130° C.

[Polyol]

The blocked isocyanate compound is preferably an adduct of isocyanate with polyol.

The adduct derived from the polyol can improve storage stability of the blocked isocyanate compound. When the image formation layer containing the adduct is imagewise heated, the resulting image increases image strength, resulting in improvement of printing durability.

Examples of the polyol include a polyhydric alcohol such as propylene glycol, triethylene glycol, glycerin, trimethylol methane, trimethylol propane, pentaerythritol, neopentyl glycol, 1,6-hexylene glycol, hexamethylene glycol, xylylene glycol, sorbitol or sucrose; polyether polyol which is prepared by polymerizing the polyhydric alcohol or a polyamine with ethylene oxide and/or propylene oxide; polytetramethylene ether polyol; polycarbonate polyol; polycaprolactone polyol; polyester polyol, which is obtained by reacting the above polyhydric alcohol with polybasic acid such as adipic acid, phthalic acid, isophthalic acid, terephthalic acid, sebatic acid, fumaric acid, maleic acid, or azelaic acid; polybutadiene polyol; acrylpolyol; castor oil; a graft copolymer polyol prepared by graft polymerization of a vinyl monomer in the presence of polyether polyol or polyester polyol; and an epoxy modified polyol. Among these, a polyol having a molecular weight of 50-5,000 such as propylene glycol, triethylene glycol, glycerin, trimethylol methane, trimethylol propane, pentaerythritol, neopentyl glycol, 1,6-hexylene glycol, butane diol, hexamethylene glycol, xylylene glycol, or sorbitol is preferred, and a low molecular weight polyol having a molecular weight of 50-500 is especially preferred.

It is preferred that the content of the polyol is such an amount that the amount of the hydroxyl group of the polyol is 0.1-0.9 equivalent of the isocyanate group of the isocyanate compound. The above range of the hydroxyl group of the polyol provides improved storage stability of the blocked isocyanate compound.

[Blocking Method]

As a blocking method of an isocyanate compound, there is, for example, a method comprising the steps of dropwise adding a blocking material to the isocyanate compound at 40 to 120° C. while stirring under an anhydrous condition and an inert gas atmosphere, and after addition, stirring the mixture solution for additional several hours. In this method, a solvent can be used, and a known catalyst such as an organometallic compound, a tertiary amine or a metal salt can be also used.

Examples of the organometallic catalyst include a tin catalyst such as stannous octoate, dibutyltin diacetate, or dibutyltin dilaurate; and a lead catalyst such as lead 2-ethylhexanoate. Examples of the tertiary amine include triethylamine, N,N-dimethylcyclohexylamine, triethylenediamine, N,N'-dimethylpiperazine, and diazabicyclo (2,2,2)-octane. Examples of the metal salt include cobalt naphthenate, calcium naphthenate, and lithium naphthenate. These catalysts are used in an amount of ordinarily 0.001-2% by weight, and preferably 0.01-1% by weight based on 100 parts by weight of isocyanate compound.

The blocked isocyanate compound, which is a reaction product of an isocyanate compound, a polyol, and a blocking material, is obtained by reacting the isocyanate compound with the polyol, and then reacting a residual isocyanate group with the blocking material or by reacting the isocyanate compound with the blocking material, and then reacting a residual isocyanate group with the polyol.

The blocked isocyanate compound has an average molecular weight of preferably 500-2,000 in weight average molecular weight, and more preferably 600-1,000. This range of the molecular weight provides good reactivity and storage stability.

[Manufacture of Aqueous Dispersion]

The blocked isocyanate compound obtained above is added to an aqueous solution containing a surfactant, and vigorously stirred in a homogenizer to obtain an aqueous dispersion of blocked isocyanate compound.

Examples of the surfactant include an anionic surfactant such as sodium dodecylbenzene sulfonate, sodium lauryl sulfate, sodium dodecyldiphenylether disulfonate, or sodium dialkyl succinate sulfonate; a nonionic surfactant such as polyoxyethylenealkyl ester or polyoxyethylenealkyl aryl ester; and an amphoteric surfactant including an alkyl betaine such as lauryl bataines or stearyl betaine and an amino acid such as lauryl β-alanine, lauryldi(aminoethyl)glycine, or octyldi(aminoethyl)glycine. These surfactant may be used singly or in combination. Among these, the nonionic surfactant is preferred.

The solid content of the aqueous dispersion of the blocked isocyanate compound is preferably 10-80% by weight. The surfactant content of the aqueous dispersion is preferably 0.01-20% by weight based on the solid content of the aqueous dispersion.

When an organic solvent is used in a blocking reaction of the isocyanate compound, the organic solvent can be removed from the resulting aqueous dispersion.

(Water Soluble Polymeric Compound)

The thermosensitive image formation layer of the invention preferably contains a water-soluble polymeric compound.

The water-soluble polymeric compound is a compound in which solubility based on water at 25° C. is at least 1% by weight. Provided are resins such as polysaccharide, polyethylene oxide, polypropylene oxide, polyvinyl alcohol, polyethylene glycol (PEG), polyvinyl ether, polyacrylic acid, polyacrylic acid salt, polyacrylamide, and polyvinyl pyrrolidone, for example. Of these, polysaccharide, polyacrylic acid, polyacrylic acid salt, and polyacrylamide are preferable.

Starches, celluloses, polyuronic acid, pullulan, chitosan and their derivatives are usable as polysaccharides, but a methyl cellulose salt, a carboxymethyl cellulose salt, a hydroxyethyl cellulose salt and their cellulose derivatives are particularly preferable. a sodium salt or ammonium salt of carboxymethyl cellulose is mare preferable.

The polyacrylic acid, polyacrylic acid salt, or polyacrylamide has preferably a molecular weight of 3,000-1,000,000, and more preferably a molecular weight of 5000-500,000.

(Other Materials Containable in Thermosensitive Image Formation Layer)

The thermosensitive image formation layer may contain a surfactant. Si- or F-containing surfactant is usable, but Si-containing surfactant is particularly preferable in view of no generation of printing contamination. The content of the surfactant is preferably 0.01-3% by weight, based on the total weight of the hydrophilic layer (or the solid content of the coating liquid), and more preferably 0.03-1% by weight.

Acid (phosphoric acid, acetic acid, or such), or alkali (sodium hydrate, silicate, phosphate, or such) may further be contained.

In the case of a printing plate material, it is preferable that a thermosensitive image formation layer is a on-press developable layer.

The on-press developable layer is a layer in which after heating, a thermosensitive image formation layer at non-image portions is removed by dampening water or printing ink during printing, resulting in exhibiting dampening water retention ability at the removal portions.

(Support)

The support of the present invention is a plate or film capable of carrying a thermosensitive image formation layer, and those well known in the art as substrates for printing plates can be used for the support of the present invention.

Examples of the support include a metal plate, a plastic film sheet, a paper sheet treated with polyolefin, and composite sheets such as laminates thereof.

The thickness of the support is not specifically limited, but a thickness of 10-1000 μm is preferable in view of easily handling, and a thickness of 50-500 μm is more preferable.

Examples of the metal plate used as a support include iron, stainless steel, and aluminum. Aluminum is especially preferable in its gravity and stiffness. Aluminum is ordinarily used after degreased with an alkali, an acid or a solvent to remove oil on the surface, which has been used when rolled and wound around a spool.

The degreasing is carried out preferably employing an aqueous alkali solution. In order to increase adhesion between the support and a coating layer, it is preferred that the surface of the support is subjected to adhesion increasing treatment or is coated with a subbing layer. For example, the support is immersed in a solution containing silicate or a coupling agent such as a silane coupling agent, or the support is coated with the solution and then sufficiently dried. Anodization treatment is considered to be one kind of adhesion increasing treatment, and can be used. The anodization treatment and the immersing or coating treatment described above can be used in combination.

Aluminum plate (so-called grained aluminum plate subjected to hydrophilic treatment), which has been surface-roughened with a conventional method, can also be used as a support having a hydrophilic surface.

Examples of the plastic film include a polyethylene terephthalate film, a polyethylene naphthalate film, a polyimide film, a polyamide film, a polycarbonate film, a polysulfone film, a polyphenylene oxide film, and a cellulose ester film.

In order to increase adhesion between the support and a coating layer, it is preferred that the surface of the plastic film is subjected to adhesion increasing treatment or is coated with a subbing layer. Examples of the adhesion increasing treatment include corona discharge treatment, flame treatment, plasma treatment and UV light irradiation treatment. Examples of the subbing layer include a layer containing gelatin or latex. The subbing layer can contain a known organic or inorganic electrically conductive material.

A support with a known backcoat layer coated can be used in order to control slippage of the rear surface of the support, for example, in order to reduce friction between the rear surface and a plate cylinder of a printing press).

(Hydrophilic Layer)

The hydrophilic layer in the invention is a layer capable of forming a non-image portion repelling printing ink during printing. The hydrophilic layer in the invention means one provided on the support or a surface layer of the support whose surface is subjected to hydrophilization treatment. The hydrophilic layer contains a hydrophilic material.

As the printing plate material in the invention, there is a printing plate material comprising a support having a hydrophilic layer. The hydrophilic layer may be a single layer or plural layers.

The coating amount of the hydrophilic layer is preferably 0.1-10 g/m$^2$, and more preferably 0.2-5 g/m$^2$.

Material used in the hydrophilic layer is preferably a water-insoluble hydrophilic material, and especially preferably a metal oxide.

The metal oxide is preferably metal oxide particles. Examples of the metal oxide particles include colloidal silica particles, an alumina sol, a titania sol and another metal oxide sol. The metal oxide particles may have any shape such as spherical, needle-like, and feather-like shape. The average particle size is preferably 3-100 nm, and plural kinds of metal oxide each having a different size may be used in combination. The surface of the particles may be subjected to surface treatment.

The above metal oxide particles can be used as a binder, utilizing its layer forming ability. The metal oxide particles are suitably used in a hydrophilic layer since they minimize lowering of the hydrophilicity of the layer as compared with an organic compound binder.

Among the above-mentioned, colloidal silica is particularly preferred. The colloidal silica has a high layer forming ability under a drying condition with a relative low temperature, and can provide a good layer strength even in a layer containing not less than 91% by weight of a material containing no carbon atom.

It is preferred that the colloidal silica is necklace-shaped colloidal silica or colloidal silica particles having an average particle diameter of at most 20 nm. Further, it is preferred that the colloidal silica provides an alkaline colloidal silica solution as a colloid solution.

The necklace-shaped colloidal silica is a generic term of an aqueous dispersion system of spherical silica having a primary particle size of the order of nm. The necklace-shaped colloidal silica to be used in the invention means a "pearl necklace-shaped" colloidal silica formed by connecting spherical colloidal silica particles each having a primary particle size of 10-50 μm so as to attain a length of 50-400 nm. The term of "pearl necklace-shaped" means that the image of connected colloidal silica particles is like to the shape of a pearl necklace. The bonding between the silica particles forming the necklace-shaped colloidal silica is considered to be —Si—O—Si—, which is formed by dehydration of —SiOH groups located on the surface of the silica particles. Concrete examples of the necklace-shaped colloidal silica include Snowtex-PS series produced by Nissan Kagaku Kogyo, Co., Ltd.

As the products, there are Snowtex-PS-S (the average particle size in the connected state is approximately 110 nm), Snowtex-PS-M (the average particle size in the connected state is approximately 120 nm) and Snowtex-PS-L (the average particle size in the connected state is approximately 170 nm). Acidic colloidal silicas corresponding to each of the above-mentioned are Snowtex-PS-S-O, Snowtex-PS-M-O and Snowtex-PS-L-O, respectively.

The necklace-shaped colloidal silica is preferably used in a hydrophilic layer as a porosity providing material for hydrophilic matrix phase, and porosity and strength of the layer can be secured by its addition to the layer.

Among them, the use of Snowtex-PS-S, Snowtex-PS-M or Snowtex-PS-L, each being alkaline colloidal silica particles, is particularly preferable since the strength of the hydrophilic layer is increased and occurrence of background contamination is inhibited even when a lot of prints are printed.

It is known that the binding force of the colloidal silica particles is become larger with decrease of the particle size. The average particle size of the colloidal silica particles to be used in the invention is preferably not more than 20 nm, and more preferably 3-15 nm. As above-mentioned, the alkaline colloidal silica particles show the effect of inhibiting occurrence of the background contamination. Accordingly, the use of the alkaline colloidal silica particles is particularly preferable.

Examples of the alkaline colloidal silica particles having the average particle size within the foregoing range include Snowtex-20 (average particle size: 10-20 nm), Snowtex-30 (average particle size: 10-20 nm), Snowtex-40 (average particle size: 10-20 nm), Snowtex-N (average particle size: 10-20 nm), Snowtex-S (average particle size: 8-11 nm) and Snowtex-XS (average particle size: 4-6 nm), each produced by Nissan Kagaku Co., Ltd.

The colloidal silica particles having an average particle size of not more than 20 nm, when used together with the necklace-shaped colloidal silica as described above, is particularly preferred, since appropriate porosity of the layer is maintained and the layer strength is further increased.

The ratio of the colloidal silica particles having an average particle size of not more than 20 nm to the necklace-shaped colloidal silica is preferably from 95/5 to 5/95, more preferably from 70/30 to 20/80, and most preferably from 60/40 to 30/70.

The hydrophilic layer of the present invention preferably contains porous metal oxide particles as metal oxides. Examples of the porous metal oxide particles include porous silica particles, porous aluminosilicate particles or zeolite particles.

The porous silica particles are ordinarily produced by a wet method or a dry method. By the wet method, the porous silica particles can be obtained by drying and pulverizing a gel prepared by neutralizing an aqueous silicate solution, or pulverizing the precipitate formed by neutralization. By the dry method, the porous silica particles are prepared by combustion of silicon tetrachloride together with hydrogen and oxygen to precipitate silica. The porosity and the particle size of such particles can be controlled by variation of the production conditions.

The porous silica particles prepared from the gel by the wet method is particularly preferred.

The porous aluminosilicate particles can be prepared by the method described in, for example, JP O.P.I. No. 10-71764. Thus prepared aluminosilicate particles are amorphous complex particles synthesized by hydrolysis of aluminum alkoxide and silicon alkoxide as the major components. The particles can be synthesized so that the ratio of alumina to silica in the particles is within the range of from 1:4 to 4:1. Complex particles composed of three or more components prepared by an addition of another metal alkoxide may also be used in the invention. In such a particle, the porosity and the particle size can be controlled by adjustment of the production conditions.

The porosity of the particles is preferably at least 1.0 ml/g, more preferably at least 1.2 ml/g, and most preferably of 1.8-2.5 ml/g, in terms of pore volume before the dispersion.

The particle size of the particles dispersed in the hydrophilic layer (or in the dispersed state before formed as a layer) is preferably at most 1 μm, and more preferably at most 0.5 μm.

The diameter of the porous inorganic particles in the hydrophilic layer is preferably at most 1 μm, and more preferably at most 0.5 μm.

The hydrophilic layer of the printing plate material in the invention can contain layer structural clay mineral particles as a metal oxide. Examples of the layer structural clay mineral particles include a clay mineral such as kaolinite, halloysite, talk, smectite such as montmorillonite, beidellite, hectorite and saponite, vermiculite, mica and chlorite; hydrotalcite; and a layer structural polysilicate such as kanemite, makatite, ilerite, magadiite and kenyte. Among them, ones having a higher electric charge density of the unit layer are higher in the polarity and in the hydrophilicity. Preferable charge density is at least 0.25, more preferably at least 0.6. Examples of the layer structural mineral particles having such a charge density include smectite having a negative charge density of 0.25-0.6 and bermiculite having a negative charge density of 0.6-0.9. Synthesized fluorinated mica is preferable since one having a stable quality, such as the particle diameter, is available. Among the synthesized fluorinated mica, swellable one is preferable and one freely swellable is more preferable.

An intercalation compound of the foregoing layer structural mineral particles such as a pillared crystal, or one treated by an ion exchange treatment or a surface treatment such as a silane coupling treatment or a complication treatment with an organic binder is also usable.

The planar structural mineral particles are preferably in the plate form, and have an average particle diameter (an average of the largest particle length) of preferably at most 20 μm, and an average aspect ratio (the largest particle length/the particle thickness) of preferably at least 20, and more preferably at least 50, in a state contained in the layer including the case that the particles are subjected to a swelling process and a dispersing layer-separation process. The particles more preferably have an average particle diameter of preferably at most 5 μm, and an average aspect ratio of at least 50, and still more preferably have an average particle diameter of preferably at most 1 μm, and an average aspect ratio of at least 50. When the particle diameter is within the foregoing range, continuity to the parallel direction, which is a trait of the layer structural particle, and softness, are given to the coated layer so that a strong dry layer in which a crack is difficult to be formed can be obtained. The coating solution containing the layer structural clay mineral particles in a large amount can minimize particle sedimentation due to a viscosity increasing effect.

The content of the layer structural clay mineral particles is preferably 0.1-30% by weight, and more preferably from 1 to 10% by weight based on the total weight of the layer. Particularly, the addition of the swellable synthesized fluorinated mica or smectite is effective if the adding amount is small. The layer structural clay mineral particles may be added in the form of powder to a coating liquid, but it is preferred that gel of the particles which is obtained by being swelled in water, is added to the coating liquid in order to obtain a good dispersity according to an easy coating liquid preparation method which requires no dispersion process comprising dispersion due to media.

An aqueous solution of a silicate is also usable as another additive to the hydrophilic matrix phase in the invention. An alkali metal silicate such as sodium silicate, potassium silicate or lithium silicate is preferable, and the $SiO_2/M_2O$ is preferably selected so that the pH value of the coating liquid after addition of the silicate exceeds 13 in order to prevent dissolution of the porous metal oxide particles or the colloidal silica particles.

An inorganic polymer or an inorganic-organic hybrid polymer prepared by a sol-gel method employing a metal alkoxide. Known methods described in S. Sakka "Application of Sol-Gel Method" or in the publications cited in the above publication can be applied to prepare the inorganic polymer or the inorganic-organic hybridpolymer by the sol-gel method. In the present invention, the hydrophilic layer can contain a hydrophilic organic resin.

Examples of the hydrophilic organic resin include polysaccharides, polyethylene oxide, polypropylene oxide, polyvinyl alcohol, polyethylene glycol (PEG), polyvinyl ether, a styrene-butadiene copolymer, a conjugation diene polymer latex of methyl methacrylate-butadiene copolymer, an acryl polymer latex, a vinyl polymer latex, polyacrylamide, and polyvinyl pyrrolidone.

A cationic resin may also be contained in the hydrophilic layer. Examples of the cationic resin include a polyalkylenepolyamine such as a polyethyleneamine or polypropylenepolyamine or its derivative, an acryl resin having a tertiary amino group or a quaternary ammonium group and diacrylamine. The cationic resin may be added in a form of fine particles. Examples of such particles include the cationic microgel described in Japanese Patent O.P.I. Publication No. 6-161101.

In the present invention, it is preferred that the hydrophilic organic resin contained in the hydrophilic layer is a water soluble resin, and at least a part of the resin exists in the hydrophilic layer in a state capable of being dissolved in water.

The water-soluble resin contained in the hydrophilic layer is preferably a saccharide.

As the saccharides, oligosaccharide detailed later can be used, but polysaccharides are preferably used.

As the polysaccharide, starches, celluloses, polyuronic acid and pullulan can be used. Among them, a cellulose derivative such as a methyl cellulose salt, a carboxymethyl cellulose salt or a hydroxyethyl cellulose salt is preferable, and a sodium or ammonium salt of carboxymethyl cellulose is more preferable.

These polysaccharides can form a preferred surface shape of the hydrophilic layer.

The surface of the hydrophilic layer preferably has a convexoconcave structure having a pitch of 0.1-50 μm such as the grained aluminum surface of an aluminum PS plate. The water retention ability and the image maintaining ability are raised by such a convexoconcave structure of the surface.

Such a convexoconcave structure can also be formed by adding in an appropriate amount a filler having a suitable particle diameter to the coating liquid of the hydrophilic layer. However, the convexoconcave structure is preferably formed by coating a coating liquid for the hydrophilic layer containing the alkaline colloidal silica and the water-soluble polysaccharide so that the phase separation occurs at the time of drying the coated liquid, whereby a structure is obtained which provides a good printing performance.

The shape of the convexoconcave structure such as the pitch and the surface roughness thereof can be suitably controlled by the kinds and the adding amount of the alkaline colloidal silica particles, the kinds and the adding amount of the water-soluble polysaccharide, the kinds and the adding amount of another additive, a solid concentration of the coating liquid, a wet layer thickness or a drying condition.

The pitch in the convexoconcave structure is preferably 0.2-30 μm, and more preferably 0.5-20 μm. A multi-layered convexoconcave structure may be formed in which a convexoconcave structure with a smaller pitch is formed on one with a larger pitch.

The hydrophilic layer has a surface roughness Ra of preferably 100-1000 nm, and more preferably 150-600 nm.

The thickness of the hydrophilic layer is 0.01-50 μm, preferably 0.2-10 μm, and more preferably 0.5-3 μm.

A water-soluble surfactant may be added for improving the coating ability of the coating liquid for the hydrophilic layer in the invention. A Si-containing surfactant and an F-containing surfactant are preferably used. The Si-containing surfactant is especially preferred in that it minimizes printing contamination.

The content of the surfactant is preferably 0.01-3% by weight, and more preferably 0.03-1% by weight based on the total weight of the hydrophilic layer (or the solid content of the coating liquid).

The hydrophilic layer can contain a phosphate. Since a coating liquid for the hydrophilic layer is preferably alkaline, the phosphate to be added to the hydrophilic layer is preferably sodium phosphate or sodium monohydrogen phosphate. The addition of the phosphate provides improved reproduction of dots at shadow portions. The content of the phosphate is preferably 0.1-5% by weight, and more preferably 0.5-2% by weight in terms of amount excluding hydrated water.

The preferred hydrophilic support is an aluminum plate whose surface has been subjected to hydrophilization treatment, and cab be obtained by surface-roughening the aluminum plate.

It is preferable that the aluminum plate is subjected to degreasing treatment for removing rolling oil prior to surface roughening (graining). The degreasing treatments include degreasing treatment employing solvents such as trichlene and thinner, and an emulsion degreasing treatment employing an emulsion such as kerosene or triethanol. It is also possible to use an aqueous alkali solution such as caustic soda for the degreasing treatment. When an aqueous alkali solution such as caustic soda is used for the degreasing treatment, it is possible to remove soils and an oxidized film which can not be removed by the above-mentioned degreasing treatment alone. When an aqueous alkali solution such as caustic soda is used for the degreasing treatment, the resulting support is preferably subjected to desmut treatment in an aqueous solution of an acid such as phosphoric acid, nitric acid, sulfuric acid, chromic acid, or a mixture thereof, since smut is produced on the surface of the support. The surface roughening methods include a mechanical surface roughening method and an electrolytic surface roughening method electrolytically etching the support surface.

Though there is no restriction for the mechanical surface roughening method, a brushing roughening method and a honing roughening method are preferable.

Though there is no restriction for the electrolytic surface roughening method, a method, in which the support is electrolytically surface roughened in an acidic electrolytic solution, is preferred.

After the support has been electrolytically surface roughened, it is preferably dipped in an acid or an aqueous alkali solution in order to remove aluminum dust, etc. produced in the surface of the support. Examples of the acid include sulfuric acid, persulfuric acid, hydrofluoric acid, phosphoric acid, nitric acid and hydrochloric acid, and examples of the alkali include sodium hydroxide and potassium hydroxide. Among those mentioned above, the aqueous alkali solution is preferably used. The dissolution amount of aluminum in the support surface is preferably 0.5-5 g/m$^2$. After the support has been dipped in the aqueous alkali solution, it is preferable for the support to be dipped in an acid such as phosphoric acid, nitric acid, sulfuric acid and chromic acid, or in a mixed acid thereof, for neutralization.

The mechanical surface roughening and electrolytic surface roughening may be carried out singly, and the mechanical surface roughening followed by the electrolytic surface roughening may be carried out.

After the surface roughening, anodizing treatment may be carried out. There is no restriction in particular for the method of anodizing treatment used in the invention, and known methods can be used. The anodizing treatment forms an anodization film on the surface of the support.

The support which has been subjected to anodizing treatment is optionally subjected to sealing treatment. For the sealing treatment, it is possible to use known methods using hot water, boiling water, steam, a sodium silicate solution, an aqueous dichromate solution, a nitrite solution and an ammonium acetate solution.

After the above treatment, the support is suitably undercoated with a water soluble resin such as polyvinyl phosphonic acid, a polymer or copolymer having a sulfonic acid in the side chain, or polyacrylic acid; a water soluble metal salt such as zinc borate; a yellow dye; an amine salt; and so on, for hydrophilization treatment. The sol-gel treatment support disclosed in Japanese Patent O.P.I. Publication No. 5-304358, which has a functional group capable of causing addition reaction by radicals as a covalent bond, is suitably used.

(Protective Layer)

A protective layer may be provided on a thermosensitive image formation layer of the present invention.

The above water-soluble resin or water-dispersible resin is preferably usable as a material employed for a protective layer.

The hydrophilic overcoat layer described in Japanese Patent O.P.I. Publication Nos. 2002-19318 and 2002-86948 may also be preferably usable.

The coating amount of a protective layer is 0.01-10 g/m$^2$, preferably 0.1-3 g/m$^2$, and more preferably 0.2-2 g/m$^2$.

(Light Exposure)

Though imagewise heating in the present invention is conducted employing a thermal head and the like, heating via laser exposure is preferable in order to obtain fine images, and heating via infrared laser exposure is specifically preferable when the image recording material is a printing plate material.

In the case of a printing plate material, images are exposed to laser light, depending on image data, and the plate making is subsequently carried out for printing.

The image exposure is preferably scanning exposure, which is carried out employing a laser which can emit light having a wavelength of infrared and/or near-infrared regions, that is, a wavelength of 700-1500 nm.

As the laser, a gas laser can be used, but scanning exposure is preferably conducted by a semi-conductor laser, which emits light having a near-infrared region wavelength.

A device suitable for the scanning exposure may be any device capable of forming an image on the printing plate material surface according to image signals from a computer employing the semi-conductor laser.

Generally, the following scanning exposure processes are provided.

(1) A process in which a plate precursor provided on a fixed horizontal plate is scanning exposed in two dimensions, employing one or several laser beams.

(2) A process in which the surface of a plate precursor provided along the inner peripheral wall of a fixed cylinder is subjected to scanning exposure in the rotational direction (in the main scanning direction) of the cylinder, employing one or several lasers located inside the cylinder, moving the lasers in the normal direction (in the sub-scanning direction) to the rotational direction of the cylinder.

(3) A process in which the surface of a plate precursor provided along the outer peripheral wall of a fixed cylinder is subjected to scanning exposure in the rotational direction (in the main scanning direction) of the cylinder, employing one or several lasers located inside the cylinder, moving the lasers in the normal direction (in the sub-scanning direction) to the rotational direction of the cylinder.

(On-Press Development Process)

When an image recording material of the present invention is a printing plate material, a thermosensitive image formation layer is preferably a developable layer on a printing press.

The developable layer on a printing press is a layer in which the thermosensitive image formation layer is removed at non-image portions by using dampening water and/or ink on the printing press.

The developing treatment on a printing press means that removal on a press of the image formation layer at unexposed portions is carried out. A dampening roller and an inking roller are also brought into contact with the image formation layer while rotating the plate cylinder, to be carried out according to various sequences such as those described below or another appropriate sequence. The supplied amount of dampening water may be adjusted to be greater or smaller than the amount ordinarily supplied in printing, and the adjustment may be carried out stepwise or continuously.

(1) A dampening roller is brought into contact with the image formation layer of a printing plate material on the plate cylinder during one to several tens of rotations of the plate cylinder, and then an inking roller brought into contact with the image formation layer during the next one to tens of rotations of the plate cylinder. Thereafter, printing is carried out.

(2) An inking roller is brought into contact with the image formation layer of a printing plate material on the plate cylinder during one to several tens of rotations of the plate cylinder, and then a dampening roller brought into contact with the image formation layer during the next one to tens of rotations of the plate cylinder. Thereafter, printing is carried out.

(3) An inking roller and a dampening roller are brought into contact with the image formation layer of a printing plate material on the plate cylinder during one to several tens of rotations of the plate cylinder. Thereafter, printing is carried out.

(Printing Press)

When the image recording material is a printing plate material, a commonly known printing press equipped with a member to supply the printing plate surface with dampening water as well as a member to supply the printing plate surface with ink can be employed as a printing press.

Though either an infeed supply type dampener or a continuous supply type dampener can be employed to supply the printing plate surface with dampening water, the continuous supply type dampener is preferably used.

(Dampening Water)

Conventionally usable dampening water such as tap water, well water or such can be employed for printing a planographic printing plate, when the image recording material is a printing plate material. A phosphoric acid or its salt, a citric acid or its salt, a nitric acid or its salt, and an acetic acid or its salt, for example, may be contained in the dampening water. Specifically contained may be acids such as a phosphoric acid, an ammonium phosphoric acid, a sodium phosphoric acid, a citric acid, an ammonium citric acid, a sodium citric acid, an acetic acid, an ammonium acetic acid and a sodium acetic acid; water-soluble polymer compounds such as carboxy methyl cellulose and carboxy ethyl cellulose; solvents such as alcohol and multivalent alcohol; or surfactants such as an anionic surfactant, a cationic surfactant, an amphoteric surfactant and a nonionic surfactant. It is preferable that the content is 0.05-0.1% by weight, based on the total amount.

EXAMPLE

Next, the present invention will now be described in detail referring to examples, however, the present invention is not limited thereto. In the examples, "parts" is parts by weight, unless otherwise specifically specified.

(Preparation of Support 1)

Both surfaces of a 175 μm thick biaxially stretched polyester sheet were corona discharged under condition of 8 $W/m^2$·minute. Then, the surface on one side of the resulting sheet was coated with following subbing layer coating solution a to give a dry thickness of 0.8 μm, and then coated with following subbing layer coating solution b to give a dry thickness of 0.1 μm, while the first subbing layer was corona discharged under condition of 8 $W/M^2$·minute, each layer was dried at 180° C. for 4 minutes (subbing layer A was formed).

Successively, the surface on the other side of the resulting sheet was coated with following subbing layer coating solution c to give a dry thickness of 0.8 μm, and then coated with following subbing layer coating solution d to give a dry thickness of 1.0 μm, while the subbing layer was corona discharged under condition of 8 $W/m^2$·minute, each layer was dried at 180°C. for 4 minutes (subbing layer B was formed). Thus, support 1 having a subbing layer on each surface was prepared. The support 1 had a surface electric resistance at 25°C. and 25% RH of $10^8$ Ω.

| <<Subbing layer coating solution a>> | |
|---|---|
| Latex of styrene/glycidyl methacrylate/butyl acrylate (60/39/1 by mole) copolymer (Tg = 75° C.) | 6.3 parts |
| Latex of styrene/glycidyl methacrylate/butyl acrylate (20/40/40 by mole) copolymer | 1.6 parts |
| Anionic surfactant S-l | 0.1 parts |
| Water | 92.0 parts |

| <<Subbing layer coating solution b>> | |
|---|---|
| Gelatin | 1 part |
| Anionic surfactant S-1 | 0.05 parts |
| Hardener H-1 | 0.02 parts |
| Matting agent (Silica particles with 3.5 μm in average particle diameter) | 0.02 parts |
| Antifungal agent F-1 | 0.01 parts |
| Water | 98.9 parts |

S-1

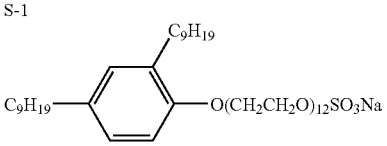

H-1

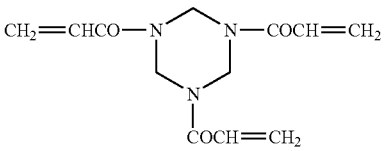

-continued

| <<Subbing layer coating solution b>> |
|---|

F-1

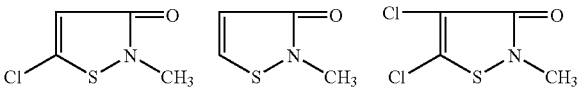

(Component A) (Component B) (Component C)

(Component A):(Component B):(Component C) = 50:46:4 (by mole)

| <<Subbing layer coating solution c>> | |
|---|---|
| Latex of styrene/glycidyl methacrylate/butyl acrylate (20/40/40 by mole) copolymer | 0.4 parts |
| Latex of styrene/glycidyl methacrylate/butyl acrylate/acetoacetoxyethyl methacrylate (39/40/20/1 by mole) copolymer | 7.6 parts |
| Anionic surfactant S-1 | 0.1 parts |
| Water | 91.9 parts |

| <<Subbing layer coating solution d>> | |
|---|---|
| Electrically conductive composite of component d-1/component d-2/component d-3 (66/31/1 by weight) | 6.4 parts |
| Hardener H-2 | 0.7 parts |
| Anionic surfactant S-1 | 0.07 parts |
| Matting agent (Silica particles with 3.5 μm in average particle diameter) | 0.03 parts |
| Water | 92.8 parts |

Component d-1; Anionically polymeric compound of sodium styrenesulfonate/maleic acid (50/50 by mole) copymer Component d-2; Latex of styrene/glycidyl methacrylate/butyl acrylate (40/40/20 by mole) copolymer Component d-3; Polymeric activator of styrene/sodium isoprenesulfonate (80/20 by mole)

H-2

Mixture of three compounds below

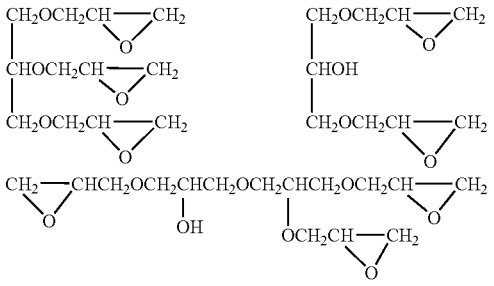

(Preparation of Support 2)

A 0.24 mm thick aluminum plate (material 1050, refining H16) was immersed in an aqueous 1% by weight sodium hydroxide solution at 50° C. to give an aluminum dissolution amount of 2 $g/m^2$, washed with water, immersed in an aqueous 10% by weight nitric acid solution at 25° C. for 30 seconds to neutralize, and washed with water, and subquently dried at 100° C. for 3 minutes to obtain support 2.

Example 1

Image Recording Material

Preparation of Coating Solution

Coating solution 1 having the following composition is prepared. Materials as shown in Table 1, except for the surfactant, were stirred and mixed, employing a homogenizer, and after the surfactant was added while stirring, the resulting admixture was filtered to obtain coating solution 1.

Composition of coating solution 1 (solid content of 30% by weight) (In Table 1, numerical values are parts by weight, unless otherwise specified.)

TABLE 1

| Materials | Coating solution 1 |
|---|---|
| Colloidal silica (alkali type): Snowtex-XS (solid content of 20% by weight and 5 nm in average particle diameter, produced by Nissan Kagaku Co., Ltd.) | 45.60 |
| Acryl emulsion AE986A (solid content of 35.5% by weight and Tg of 2° C., produced by JSR Co., Ltd.) | 21.43 |
| Black iron oxide particles ABL-207, produced by Titan Kogyo K.K. (true specific gravity: 5.0 g/cm$^3$, octahedral form, average particle size: 0.2 μm, specific surface area: 6.7 m$^2$/g, Hc: 9.95 kA/m, σs: 85.7 Am$^2$/kg, σr/σs: 0.112) | 13.20 |
| Aqueous 10% by weight sodium phosphate • dodecahydrate (Reagent produced by Kanto Kagaku Co., Ltd.) solution | 1.50 |
| Aqueous 1% by weight solution of Si-containing surfactant FZ2161 (Produced by Nippon Unicar Co., Ltd.) | 3.00 |
| Pure water | 15.27 |

Next, thermosensitive image formation layer coating solutions (1)-(8) having the following composition were prepared. After each of the materials in Table 2 was sufficiently stirred and mixed, the resulting admixture was filtered to prepare each coating solution.

Composition of each of thermosensitive image formation layer coating solutions (1)-(8) (solid content of 8% by weight) (In Table 2, numerical values are parts by weight, unless otherwise specified.)

TABLE 2

| | Thermosensitive image formation layer coating solution No. | | | | | | | |
|---|---|---|---|---|---|---|---|---|
| Materials | (1) | (2) | (3) | (4) | (5) | (6) | (7) | (8) |
| *1 | 11.2 | | | | | | | |
| *2 | | 9.60 | 12.8 | | | | | |
| *3 | | | | 12.00 | | | | |
| *4 | | | | | 11.20 | | | |
| *5 | | | | | | 12.80 | | |
| *6 | | | | | | | 14.00 | |
| *7 | | | | | | | | 12.80 |
| *8 | 5.63 | 7.89 | 3.38 | 4.51 | 5.63 | 3.38 | 5.63 | 3.38 |
| *9 | 40.00 | 40.00 | 40.00 | 40.00 | 40.00 | 40.00 | 40.00 | 40.00 |
| Pure water | 43.17 | 42.51 | 43.82 | 43.49 | 43.17 | 43.82 | 40.37 | 43.82 |

*1: Thermoplastic spherical particle, Styrene particle, Average particle diameter: 160 nm, Tg: 100° C., Aqueous 50% by weight dispersion
*2: Thermoplastic spherical particle, Styrene-butadiene particle, Average particle diameter: 200 nm, Tg: 60° C., Aqueous 50% by weight dispersion
*3: Thermoplastic spherical particle, Styrene-butadiene particle, Average particle diameter: 250 nm, Tg: 60° C., Aqueous 50% by weight dispersion
*4: Thermoplastic spherical particle, Styrene-butadiene particle, Average particle diameter: 300 nm, Tg: 80° C., Aqueous 50% by weight dispersion TABLE 2-continued

| | Thermosensitive image formation layer coating solution No. | | | | | | | |
|---|---|---|---|---|---|---|---|---|
| Materials | (1) | (2) | (3) | (4) | (5) | (6) | (7) | (8) |

*5: Thermoplastic spherical particle, Styrene particle, Average particle diameter: 450 nm, Tg: 100° C., Aqueous 50% by weight dispersion
*6: Thermoplastic spherical particle, Styrene-acryl particle, Average particle diameter: 90 nm, Tg: 60° C., Aqueous 40% by weight dispersion
*7: Thermoplastic spherical particle, Styrene particle, Average particle diameter: 600 nm, Tg: 100° C., Aqueous 50% by weight dispersion
*8: Acrylic emulsion AE986A, produced by JSR Co., Ltd. (Tg: 2° C., Solid content of 35.5% by weight)
*9: Light-heat conversion material, Aqueous infrared absorbing dye (the following structure) 1% by weight solution Infrared absorbing dye

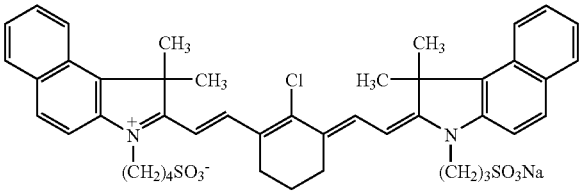

Coating solution 1 was coated on subbing layer A of support 1, employing a wire bar, and dried at 100° C. for 3 minutes to form a light-absorbing layer. A dry coating amount of the light-absorbing layer was 10 g/m$^2$.

Thereafter, each of coating solutions for thermosensitive image formation layers (1)-(8) was coated on the resulting light-absorbing layer, employing a wire bar, and dried at 55° C. for 3 minutes to obtain each of image recording material samples 1-8.

Though drying was conducted in a drying furnace inside which 55° C. hot air was blowing, a cover was put on the sample-coated surface so as not to blow the hot air directly onto the surface. A dry thickness of each of the thermosensitive image formation layers was 0.5 g/m$^2$.

(Evaluation of Coloring of Structural Color)

The degree of coloring of structural color in the resulting image recording material was visually evaluated under white light.

The evaluation items such as the degree and color via coloring and the results are shown in Table 3.

The following criteria were employed to evaluate the degree of coloring (Coloring visualized as a structural color is totally different from coloring via addition of an infrared absorbing dye into a thermosensitive image formation layer, and is clearly distinguishable).

A: Coloring is clearly recognizable.

B: Coloring is recognizable though at a low level.

C: Coloring is unrecognizable.

(Image Recording Employing Infrared Laser)

Each of the image recording material samples was mounted on an exposure drum, and imagewise exposed. The exposure was carried out employing an infrared laser (having a wavelength of 830 nm and a beam spot diameter of 18 μm) at a resolution of 2400 dpi ("dpi" herein shows the number of dots per 2.54 cm) and at a screen line number of 175 to form an image.

An image pattern used for the exposure had a solid image and a dot image with a dot area of 1-99%. The exposure energy was set to 300 mJ/cm$^2$.

(Evaluation of Visibility After Image Recording)

The condition of an image formation layer at exposed portions, and the degree of visibility at exposed/unexposed portions used white light were visually evaluated. The results are shown in Table 3.

The following criteria were employed to evaluate the degree of visibility.

A: Exposed/unexposed portions are clearly distinguishable.

B: Exposed/unexposed portions are distinguishable.

C: Exposed/enexposed portions are indistinguishable.

TABLE 3

| Image recording material No. | Image formation layer coating solution No. | Degree of coloring of structural color | Color of colored structural color | Condition of image formation layer at exposed portions | Visibility at exposed/ unexposed portions | Remarks |
|---|---|---|---|---|---|---|
| 1 | (1) | A | Blue | *1 | A | Example |
| 2 | (2) | A | Green | *2 | A | Example |
| 3 | (3) | A | Green | *3 | A | Example |
| 4 | (4) | A | Green | *4 | A | Example |
| 5 | (5) | A | Green | *5 | A | Example |
| 6 | (6) | B | Red | *6 | B | Example |
| 7 | (7) | C | Non | *7 | C | Comparative example |
| 8 | (8) | C | Non | *8 | C | Comparative example |

*1: Structural color disappears, and hidden color of a light-absorbing layer is visualized.
*2: Structural color disappears, and hidden color of a light-absorbing layer is visualized.
*3: Structural color disappears, and hidden color of a light-absorbing layer is visualized.
*4: Structural color disappears, and hidden color of a light-absorbing layer is visualized.
*5: Structural color disappears, and hidden color of a light-absorbing layer is visualized.
*6: Structural color disappears, and hidden color of a light-absorbing layer is visualized.
*7: Visualized color of a light-absorbing layer is changed into milky-white slightly.
*8: Visualized color as grey is changed into charcoal slightly.

As is clear from Table 3, it is to be understood that a image recording material of the present invention exhibits a structural color, and the structural color disappears via thermal recording, whereby image recording exhibiting excellent visibility is possible to be conducted.

Example 2

Printing Plate Material

Preparation of Subbing Layer Coating Solution and Hydrophilic Layer Coating Solution After the materials in Table 4 were sufficiently stirred and mixed, the resulting admixture was filtered to prepared a subbing layer coating solution having a solid content of 20% by weight.

Composition of a subbing layer coating solution (solid content of 20% by weight) (In Table 4, numerical values are parts by weight, unless otherwise specified.)

TABLE 4

| Materials | Subbing layer |
|---|---|
| Colloidal silica (alkali type): Snowtex-XS (solid 20% by weight, produced by Nissan Kagaku Co., Ltd.) | 50.00 |
| Acryl emulsion AE986A (solid content of 35.5% by weight, Tg of 2° C., produced by JSR Co., Ltd.) | 15.31 |
| Aqueous dispersion (solid content of 30% by weight) of carbon black pigment particle SD9020 (with a true specific gravity of 2.0 g/cm$^3$, and with a primary particle diameter of at most 100 nm, produced by Dainippon Ink Co., Ltd.) | 6.67 |
| Porous metal oxide particles Silton JC-20 (porous aluminosilicate particles having an average particle diameter of 2 μm, produced by Mizusawa Kagaku Co., Ltd.) | 2.00 |
| Glycerolpolyglycidyl ether | 0.60 |

TABLE 4-continued

| Materials | Subbing layer |
|---|---|
| Aqueous 1% by weight Si-containing surfactant FZ2161 solution (Produced by Nippon Unicar Co., Ltd.) | 4.00 |
| Pure water | 21.42 |

Next, materials as shown in Table 5, except for the surfactant, were mixed and dispersed at a rotation frequency of 10,000 for 10 minutes, employing a homogenizer, and after the surfactant was added while slowly stirring, the resulting admixture was filtered to obtain a hydrophilic layer coating solution having a solid content of 30% by weight. Composition of a hydrophilic layer coating solution (solid content of 30% by weight) (In Table 5, numerical values are parts by weight, unless otherwise specified.)

TABLE 5

| Materials | Hydrophilic layer |
|---|---|
| Colloidal silica (alkali type): Snowtex-XS (solid content of 20% by weight and 5 nm in average particle diameter, produced by Nissan Kagaku Co., Ltd.) | 78.75 |
| Black iron oxide particles ABL-207, produced by Titan Kogyo K.K. (true specific gravity: 5.0 g/cm$^3$, octahedral form, average particle size: 0.2 μm, specific surface area: 6.7 m$^2$/g, Hc: 9.95 kA/m, σs: 85.7 Am$^2$/kg, σr/σs: 0.112) | 14.10 |

TABLE 5-continued

| Materials | Hydrophilic layer |
|---|---|
| Aqueous 10% by weight sodium phosphate • dodecahydrate (Reagent produced by Kanto Kagaku Co., Ltd.) solution | 1.20 |
| Aqueous 1% by weight solution of Si-containing surfactant FZ2161 (Produced by Nippon Unicar Co., Ltd.) | 3.00 |
| Pure water | 2.95 |

Preparation of Support for Hydrophilic Layer Formation

The subbing layer coating solution was coated on support 2, employing a wire bar, and dried at 200° C. for 30 seconds. A dry coating amount of the subbing layer was adjusted to 2 g/m$^2$.

Thereafter, the hydrophilic coating solution was coated on the resulting subbing layer surface, employing a wire bar, and dried at 200° C. for 30 seconds to obtain a support for hydrophilic layer formation. A dry coating amount of the hydrophilic layer was adjusted to 3.0 g/m$^2$.

Preparation of Image Formation Layer Coating Solutions (9)-(13)

10.0 parts by weight of an aqueous blocked isocyanate dispersion: WB-700 produced by Mitsui Takeda Chemical Co., Ltd. (isocyanate compound: trimethylolpropane adduct of TDI, blocking material: oxime type, releasing temperature: 120° C., a solid content: 44% by weight) were diluted by adding 75.0 parts by weight of pure water while stirring.

Next, while stirring this, an aqueous dispersion (solid content of 5% by weight) containing a blocked isocyanate compound and a water-insoluble infrared absorbing dye was acquired by dripping little by little 15.0 parts by weight of an IPA solution of a 4% by weight water-insoluble infrared absorbing dye having the following structure.

Since a water-insoluble infrared absorbing dye having the following structure is not dissolved in a water-IPA mixture solvent having the above content ratio, though it is dissolved in IPA, dyes are separated out immediately after dripping the IPA solution.

In this case, it is considered that dyes are preferentially separated out on the surface of a dispersed blocked isocyanate compound. It is also considered that the above aqueous dispersion is an aqueous composite dispersion of a blocked isocyanate compound and a water-insoluble infrared asorbing dye.

Water-insoluble infrared adsorbing dye

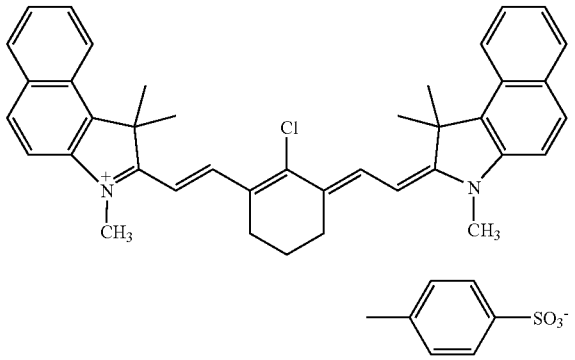

Next, after each material with each composition in Table 6 was sufficiently stirred and mixed, the resulting admixture was filtered to prepare each of image formation layer coating solutions (9)-(13).

Composition of each of image formation layer coating solutions (9)-(13) (solid content of 5% by weight) (In Table 6, numerical values are parts by weight, unless otherwise specified.)

TABLE 6

| | Image formation layer coating solution No. | | | | |
|---|---|---|---|---|---|
| Materials | (9) | (10) | (11) | (12) | (13) |
| Thermoplastic spherical particle, Styrene particle, Average particle diameter: 160 nm, Tg: 100° C., Aqueous 50% by weight dispersion | 7.00 | | | | |
| Thermoplastic spherical particle, Styrene-butadiene particle, Average particle diameter: 200 nm, Tg: 60° C., Aqueous 50% by weight dispersion | | 6.00 | | | |
| Thermoplastic spherical particle, Styrene-butadiene particle, Average particle diameter: 250 nm, Tg: 60° C., Aqueous 50% by weight dispersion | | | 8.00 | | |
| Thermoplastic spherical particle, Styrene-butadiene particle, Average particle diameter: 300 nm, Tg: 80° C., Aqueous 50% by weight dispersion | | | | 7.00 | |
| Thermoplastic spherical particle, Styrene-acryl particle, Average particle diameter: 90 nm, Tg: 60° C., Aqueous 40% by weight dispersion | | | | | 8.75 |
| Aqueous composite dispersion of a blocked isocyanate compound and an infrared absorbing dye (solid content of 5% by weight) | 1.50 | 1.50 | 1.50 | 1.50 | 1.50 |
| Aqueous hydroxyalkyl modified starch Penon JE-66 solution (solid content of 10% by weight, produced by Nippon Starch Chemical Co., Ltd.) | 27.00 | 37.00 | 17.00 | 27.00 | 27.00 |
| Pure water | 64.50 | 55.50 | 73.50 | 64.50 | 62.75 |

(Preparation of Printing Plate Material Samples 9-13)

Each of image formation layer coating solutions (9)-(13) was coated on the hydrophilic layer surface of a support for formation of the prepared hydrophilic layer, and dried at 55° C. for 1 minute. A dry coating amount of the image formation layer was adjusted to 0.4 g/m$^2$.

Next, the above was subsequently subjected to aging treatment at 55°C. for 48 hours to obtain printing plate materials 9-13.

(Evaluation of Coloring of Structural Color)

This part was conducted similarly to EXAMPLE 1. The results are shown in Table 7.

(Image Recording Employing Infrared Laser)

This part was conducted similarly to EXAMPLE 1.

(Evaluation of Visibility After Image Recording)

This part was also conducted similarly to EXAMPLE 1. The results are shown in Table 7.

(Printing Method)

A printing press DAIYA 1F-1 produced by Mitsubishi Heavy Industries, Ltd. was employed for printing, and printing was carried out employing coated paper, a dampening solution, a 2% by weight solution of Astromark 3 (produced by Nikken Kagaku Kenkyusyo Co., Ltd.) and printing ink (Toyo King Hyunity M Magenta, produced by Toyo Ink Manufacturing Co. Ltd.).

The resulting printing plate material obtained after exposure was directly mounted on a plate cylinder of a printing press, and printing up to 10000 paper sheets was conducted in the same printing condition and initial printing sequence as a conventional PS plate.

(Evaluation Printability)

[Initial Printability]

The number of prints printed from the beginning of printing until a print with good image was obtained was determined. Herein, "good image" means an image with a solid image having a density of at least 1.5 and without stain at the background. The results are shown in Table 7.

[Printing Durability]

An image was visually observed employing a loupe by sampling a print whenever 1,000 prints were obtained to evaluate small dot lacking of an image with 3% dot area, and uneven image density. The number of prints in which small dot lacking of an image with 3% dot area was first observed, or uneven image density was first observed in the solid image was determined as a measure of printing durability. The obtained number is shown in Table 7. When the small dot lacking and the uneven image density in solid image were not observed at the $10000^{th}$ print, it was represented as at least 10000.

[Effect of the Invention]

Via the foregoing structures of the present invention, provided can be an image recording material exhibiting an excellent exposure visualization property as well as an image formation process employing the image recording material, and further provided is a printing plate material exhibiting excellent on-press developability and printing durability, but also an image formation process employing the printing plate material, accompanied with an excellent exposure visualization property.

What is claimed is:

1. An image recording material comprising a support and provided thereon, a thermosensitive image formation layer, wherein the thermosensitive image formation layer contains thermoplastic spherical particles having an average particle diameter of 100-500 nm, and exhibits a structural color originated with the thermoplastic spherical particles.

2. The image recording material of claim 1, wherein the thermoplastic spherical particles exhibit an achromatic color.

3. The image recording material of claim 1, wherein a layer containing a light-heat conversion material is provided on the thermosensitive image formation layer side of the support.

4. The image recording material of claim 1, wherein the support has a hydrophilic layer, and the image recording material is a printing plate material.

5. The image recording material of claim 4, wherein the thermosensitive image formation layer is a layer that is developable on a printing press.

6. A process of forming an image on the image recording material of claim 1, wherein the image recording material is imagewise heated to change the structural color.

TABLE 7

| *a | Image formation layer coating solution No. | Degree of coloring of structural color | Color of colored structural color | *b | *c | *d | *e | *f | *g |
|---|---|---|---|---|---|---|---|---|---|
| 9 | (9) | A | Blue | *9 | A | 20 | at least 10000 | at least 10000 | Ex. |
| 10 | (10) | A | Green | *10 | A | 20 | at least 10000 | at least 10000 | Ex. |
| 11 | (11) | A | Green | *11 | A | 20 | at least 10000 | at least 10000 | Ex. |
| 12 | (12) | A | Green | *12 | A | 20 | at least 10000 | at least 10000 | Ex. |
| 13 | (13) | C | Non | *13 | C | 25 | at least 10000 | at least 10000 | Comp. |

*a: Printing plate material No.
*b: Condition of image formation layer at exposed portions
*c: Visibility at exposed/unexposed portions
*d: Initial printability (Number)
*e: Printing durability (in the case of a dot area of 3%)
*f: Printing durability (in the case of Solid)
*g: Remarks Ex.: Example Comp.: Comparative example
*9: Structural color disappears, and hidden color of a light-absorbing layer is visualized.
*10: Structural color disappears, and hidden color of a light-absorbing layer is visualized.
*11: Structural color disappears, and hidden color of a light-absorbing layer is visualized.
*12: Structural color disappears, and hidden color of a light-absorbing layer is visualized.
*13: Visualized color of a light-absorbing layer is changed into milky-white slightly.

As is clear from Table 7, it is to be understood that a printing plate material of the present invention (image recording material) exhibits a structural color, and the structural color disappears at exposure portions, whereby the printing plate material exhibits excellent visibility, accompanied with excellent initial printability and printing durability.

7. The process of forming an image on the image recording material of claim 6, wherein imagewise heating is conducted via infrared laser exposure.

* * * * *